US012234818B2

(12) United States Patent
Becher et al.

(10) Patent No.: US 12,234,818 B2
(45) Date of Patent: Feb. 25, 2025

(54) AXIAL PISTON MACHINE HAVING A SEAL RING WHICH IS SPHERICAL IN SECTIONS

(71) Applicant: Moog GmbH, Boblingen (DE)

(72) Inventors: Dirk Becher, Nufringen (DE); Daniel Flach, Gartringen (DE); Tino Kentschke, Weil der Stadt (DE)

(73) Assignee: Moog GmbH, Boblingen (DE)

( * ) Notice: Subject to any disclaimer, the term of this patent is extended or adjusted under 35 U.S.C. 154(b) by 6 days.

(21) Appl. No.: 18/010,405

(22) PCT Filed: Jun. 16, 2021

(86) PCT No.: PCT/EP2021/066203
§ 371 (c)(1),
(2) Date: Dec. 14, 2022

(87) PCT Pub. No.: WO2021/259723
PCT Pub. Date: Dec. 30, 2021

(65) Prior Publication Data

US 2023/0228264 A1 Jul. 20, 2023

(30) Foreign Application Priority Data

Jun. 24, 2020 (DE) ..... 102020116656.7

(51) Int. Cl.
*F04B 53/14* (2006.01)
*F04B 1/124* (2020.01)

(52) U.S. Cl.
CPC ..... *F04B 53/143* (2013.01); *F04B 1/124* (2013.01)

(58) Field of Classification Search
CPC ..... F04B 53/143; F04B 1/124; F03C 1/0605
See application file for complete search history.

(56) References Cited

U.S. PATENT DOCUMENTS 2,956,845 A * 10/1960 Wahlmark ..... F01B 3/0085 92/256
4,522,415 A 6/1985 Dworak et al.
6,062,569 A 5/2000 Strasser et al.

FOREIGN PATENT DOCUMENTS

CN 107338367 A * 11/2017 ..... F04B 1/124
DE 2921291 A1 11/1979
DE 3411824 A1 10/1985
DE 3719072 A1 12/1987
DE 4411383 A1 11/1994
(Continued)

OTHER PUBLICATIONS

European Patent Office (ISA/EP), International Search Report and Written Opinion in PCT/EP2021/066203, dated Oct. 11, 2021, 11 pages.

(Continued)

*Primary Examiner* — Abiy Teka
(74) *Attorney, Agent, or Firm* — Harter Secrest & Emery LLP

(57) ABSTRACT

The invention relates to an axial piston machine in which pistons carry out a stroke movement in cylinders and in which the pistons have a seal ring receptacle for a seal ring. In order to improve robustness, wear resistance, friction and stick-slip behavior, according to the invention, the seal ring is spherical, wherein the curvature radius of the seal ring, which is spherical in regions, substantially corresponds to half the diameter of the cylinder inner wall.

24 Claims, 6 Drawing Sheets

(56) References Cited

FOREIGN PATENT DOCUMENTS

Figure 1:
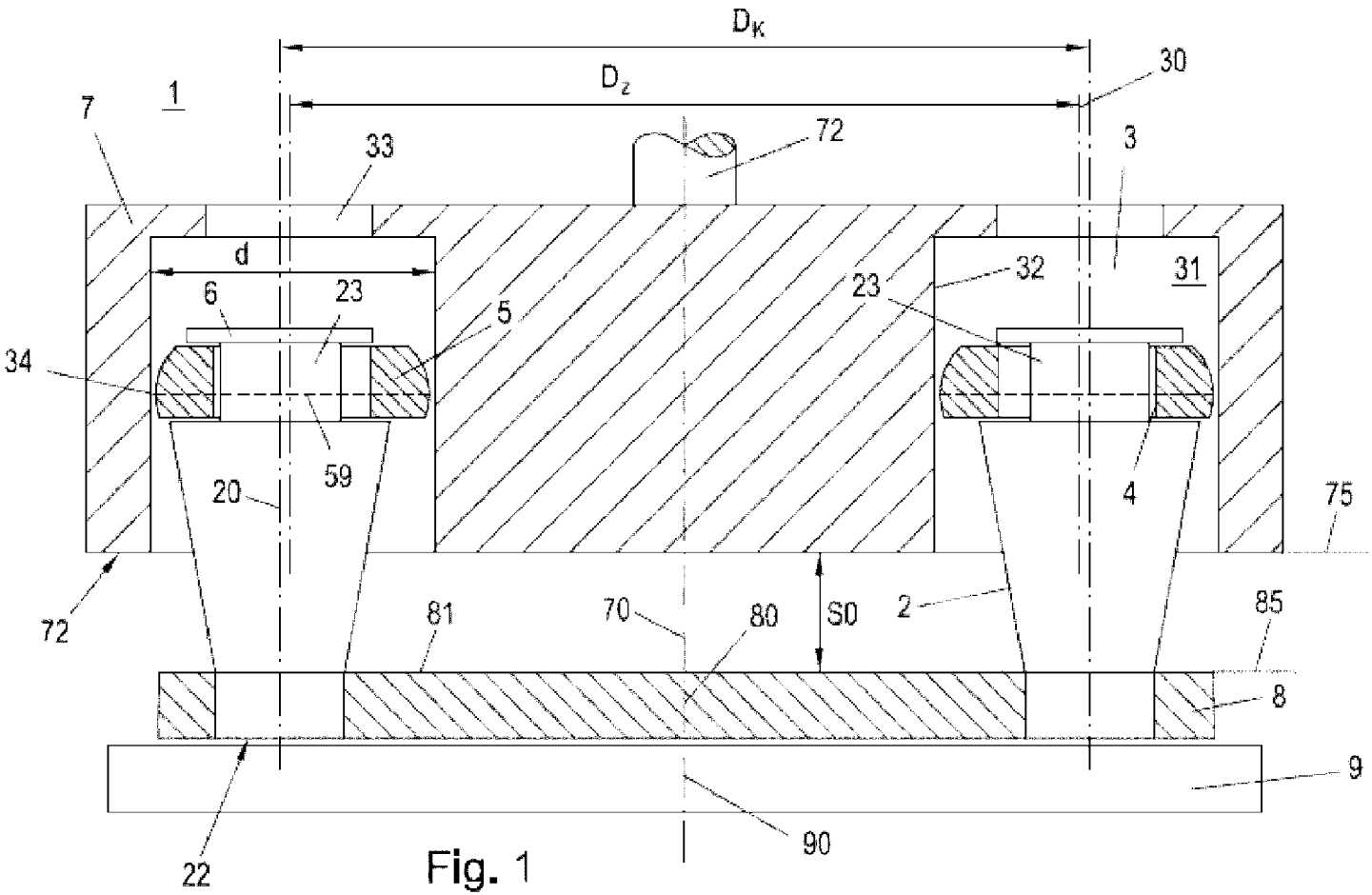

| | | | | |
|---|---|---|---|---|
| DE | 4425942 | A1 | 1/1996 | |
| DE | 19906690 | A1 * | 8/2000 | ..... F04B 1/124 |
| DE | 60316535 | T2 | 7/2008 | |
| DE | 102007011441 | A1 | 9/2008 | |
| EP | 3150852 | A1 | 4/2017 | |
| GB | 861876 | A | 3/1961 | |
| JP | 2020051276 | A | 4/2020 | |
| WO | 8600662 | A1 | 1/1986 | |

OTHER PUBLICATIONS

Ericson et al. (2018) "A Novel Axial Piston Pump/Motor Principle with Floating Pistons Design and Testing," Proceedings of the 2018 Bath/ASME Symposium on Fluid Power and Motion Control, Bath, UK: 1-9.

* cited by examiner

AXIAL PISTON MACHINE HAVING A SEAL RING WHICH IS SPHERICAL IN SECTIONS

The invention relates to an axial piston machine in which pistons in cylinders perform a stroke movement, and in which the pistons have a sealing ring seat for a sealing ring.

Common to all axial piston machines is that cylinders are arranged in a cylinder barrel, parallel to a cylinder barrel axis, in a circle around the cylinder barrel axis. Each cylinder accommodates a piston with a piston head, wherein the pistons are fastened to a plate by an end opposite the piston head about a plate axis, or are supported thereon. When the cylinder barrel axis and the plate axis intersect at an angle, a stroke movement is imposed on the piston upon a rotation of the cylinder barrel and/or the plate.

Hydraulic displacement machines, which include axial piston machines, operate on the displacement principle. They can therefore be operated both as pumps and as motors if the flow of the pressure-transmitting medium is controlled accordingly. Pumps and motors generally have the same structural design. In the case of a motor, a pressure medium is supplied under pressure to approximately a first half of the cylinder, and the pistons in question are pushed in the direction of the plate by the pressure in the cylinders and/or a mechanical connection to the plate. If the angle of the cylinder barrel axis to the plate axis is not equal to zero, this results in a tangential force component which, depending on the design, sets either the cylinder barrel or the plate in rotation and thus generates an output.

In the case of a pump, the cylinder barrel axis or the plate is set in rotation, depending on the design of the pump. If the angle of the cylinder barrel axis to the swashplate axis is not equal to zero, the continuous change in distance between the piston and the swashplate forces the piston into an oscillating stroke movement in which expansion phases alternate with compression phases. During a downward movement—the expansion phase—the piston allows the cylinder to be filled with pressure medium, which in a subsequent upward movement of the piston—the compression phase—is pushed out by the piston base and thus generates a volume flow of the pressure medium.

A prototype of an axial piston machine having a piston plate which is mounted on a swashplate, and having floating pistons, is known from the conference paper "A NOVEL AXIAL PISTON PUMP/MOTOR PRINCIPLE WITH FLOATING PISTONS DESIGN AND TESTING", Liselott Ericson and Jonas Forsell, Proceedings of the 2018 Bath/ASME Symposium on Fluid Power and Motion Control, Sep. 12-14, 2018, Bath, United Kingdom. The seal between the piston chamber and the housing interior of the hydrostatic machine which is subjected to low pressure is in this case implemented by a sealing ring which is guided between the piston and the cylinder. This sealing ring consists of a relatively soft deformable material. The conference paper discloses a material mix of polytetrafluoroethylene (PTFE) and bronze. This sealing ring has a convex sealing surface, and its outer diameter is somewhat larger than the inner diameter of the cylinder in order to achieve a sealing effect, even after deformation. The diameter of the curvature of the convex sealing surface is significantly smaller than the piston diameter. Due to the obliquely mounted piston plate, the sealing ring is moved along the inner cylinder wall at the speed of the piston, and additionally in a circular path relative to the piston bore axis. The oblique orientation of the sealing ring in the cylindrical piston bore would result in a gap. In order to counteract this gap, the diameter of the sealing ring is selected to be approximately 1% greater than the diameter of the cylinder. For the piston presented in the conference paper, the sealing ring is supported on the side facing away from the cylinder barrel by a support ring, wherein the support ring has a smaller outer diameter than the sealing ring and consists of polyether ether ketone, PEEK, a harder material than the sealing ring.

In tests, however, it has been shown that during operation, in particular at high pressures, if there is a high angle between the cylinder barrel axis and the piston plate axis, and at high rotational speeds, the sealing ring tends to extrude in the direction of the pressure-free housing interior, i.e., into the gap between the piston and the piston bore. The oblique position of the piston axis relative to the piston bore axis results kinematically in an axial offset of the piston and sealing ring. This axial offset increases the risk of the sealing ring being extruded on the side which projects further beyond the piston.

For example, at an oblique angle of 8°, the sealing ring is stretched and compressed twice by approximately 1% of its diameter during a complete revolution, which leads to material fatigue in the long term. This can result in a seal failure in the long term. However, it has also been shown that, in particular at low rotational speeds, due to the preload of the sealing ring, a greater breakaway torque and stick-slip effects lead to uneven running of the machine. What is particularly harmful about these effects is their influence in applications with a rotation speed control loop in which a stable system pressure cannot be achieved by applying a certain rotational speed (or very low rotational speeds). The control process is thus considerably more difficult due to these effects.

It is therefore an object of the invention to design an axial piston machine of the type mentioned at the outset in such a way that a low-friction, low-pulse, reliable operation at the sealing point to the piston bore is ensured in the entire operating range of the machine.

This object is achieved in an axial piston machine of the type mentioned at the outset in that the sealing ring is spherical in shape at least in a region which effects a seal on inner walls of the cylinder during the stroke movements—that is to say, is formed with a constant radius of curvature at least in this region—wherein the radius of curvature of the sealing ring, which is formed in a spherical shape in certain regions, corresponds substantially to half the diameter of the cylinder. In practice, the diameter of the sealing ring is selected to be slightly smaller than the diameter of the cylinder in order to allow sufficient clearance between the inner cylinder wall and the sealing ring. This clearance is, for example, 10 μm.

As a result of the design of the sealing ring which is formed in a spherical shape in certain regions, in which the radius of curvature of the sealing ring which is formed in a spherical shape in certain regions corresponds substantially to half the diameter of the cylinder, a sealing region is produced which is annular—that is to say, forms a closed circular line. A closed circular line results in far lower frictional forces than a seal which corresponds to a flat-surface seal due to an unfavorable sizing and/or geometry. During a rotation or tilting movement of the spherical sealing ring, although the position of the circular sealing line on the surface of the at least partially spherical sealing ring changes—since the diameter of the circular seal line is constant due to its spherical shape and the inner diameter of the cylinder is also constant-exactly the same clearance exists between the cylinder inner wall and the partially spherical sealing element, irrespective of the position of the piston in the cylinder and irrespective of the tilt angle of the piston, as long as the sealing seat allows a compensatory movement of the sealing ring transverse to the piston axis. This compensatory movement is necessary because, in the course of a rotation of the cylinder barrel, the distance between the sealing ring and the cylinder barrel axis varies cyclically due to the oblique position of the piston axis to the cylinder barrel axis.

With a mounting of the sealing ring which allows a lateral movement of the sealing ring transverse to the longitudinal axis of the piston, the sealing ring can deflect radial and tangential forces which arise from the relative movement between the inner cylinder wall and the sealing ring transverse to the piston axis. Although this was already possible in the prior art, because of the substantially smaller radius of curvature of the elastic sealing ring in relation to the inner cylinder diameter, the sealing line of the sealing ring would ideally correspond only twice during one revolution to the inner cylinder diameter if the inner cylinder diameter and the diameter of the sealing ring are selected to be approximately the same. Between these two ideal positions, the sealing circle would be significantly smaller than the inner cylinder diameter, and would therefore lead to leakages. For this reason, the diameter of the sealing ring in the prior art has been selected to be somewhat greater than the inner cylinder diameter. Due to the over-dimensioned, elastic sealing ring, these force differences are partially absorbed by reversible deformation of the elastic sealing ring, which, however, leads in the cylinder to flat sealing surfaces at some points, and at the same time to a gap between the sealing ring and the inner cylinder wall at other points. With a diameter of the sealing ring which is greater than the inner cylinder diameter, however, jamming of the sealing ring is unavoidable if a sealing ring made of a rigid material is selected.

With the design according to the invention, there is now a sealing surface in each position approximating a circular line between the inner cylinder wall and the sealing ring during a rotation of the cylinder barrel, and the clearance between the sealing ring and the cylinder wall is kept constant during the stroke movement. This makes it possible to select a non-deformable material for the sealing ring, such that an extrusion of the sealing ring is prevented even at high pressures and/or high rotational speeds of the cylinder barrel. At the same time or alternatively, the material of the sealing ring can be selected from among materials that are particularly resistant to wear. This results in a longer service life of the sealing ring, so that the sealing ring has to be replaced less, or not at all, during the service life of the piston machine.

However, since in the case of a sphere the diameter of a great circle is the same no matter in which direction the sphere is rotated, the piston element cannot jam in the cylinder during the stroke movement and the simultaneous compensatory movement, because the diameter of each of the sealing circular lines remains unchanged in relation to the diameter of the cylinder. The losses of the axial piston machine and the wear are thus reduced.

In one embodiment, the sealing ring consists of ceramic. Both oxide ceramic, such as aluminum oxide Al2O3 or zirconium dioxide ZrO2, or alternatively non-oxide ceramic, such as silicon carbide SiC or silicon nitride Si3N4, for example, are suitable for this purpose.

In a further embodiment, the sealing ring seat comprises a pin, and the sealing ring has a central inner opening corresponding to the pin, wherein the inner opening diameter of the sealing ring is selected to be larger than the pin diameter. The difference between the pin diameter and the inner diameter of the sealing ring can accordingly be selected according to the required horizontal clearance—that is to say, the clearance transverse to the piston longitudinal axis.

In a further embodiment of the axial piston machine, the piston is designed in such a manner that a pressure equalization between the piston interior and the interior of the sealing ring is made possible. Such a pressure equalization can be brought about, for example, by the sealing ring being seated in the sealing seat with vertical clearance—that is to say, clearance in the direction of the piston longitudinal axis—such that the pressure within the sealing ring seat can be dynamically adapted to the pressure in the piston chamber via the gap of the clearance. In alternative embodiments, the pressure equalization between the piston interior and the interior of the sealing ring is optionally brought about by one or more openings in the cover. In a further embodiment, pressure equalization bores, which extend from the upper side of the pin into the interior of the sealing ring, are alternatively or additionally provided. This makes it possible to use irregular geometries of the peripheral surface of the sealing ring and of the inner surface of the sealing ring for a targeted deformation of the sealing ring, in order to increase the sealing effect of the sealing ring.

In the case of irregular geometry of the peripheral surface of the sealing ring compared to the geometry of the inner surface of the sealing ring, the normal forces which act on the sealing ring due to the pressure medium in the piston chamber differ from the normal forces in the sealing ring seat which act on the inner side of the sealing ring. This can lead to deformations of the sealing ring in particular at very high pressures of the pressure medium. This deformation, which is initially perceived as undesired, is even amplified in a further embodiment in which the central inner opening of the sealing ring has a circumferential bead-like recess.

This bead-like recess allows the sealing ring to additionally expand in the piston chamber at high internal pressures. It has been shown that, even for solid cylinder barrels, when a piston chamber of the cylinder barrel is connected to the high-pressure side, this internal pressure force can lead to a widening or deformation of the corresponding cylinder. Such a one-sided widening would lead to an increase in the gap between the inner cylinder wall and the sealing ring. It is therefore expedient to design the geometry of the sealing ring such that it can also expand, and thus the gap between the piston bore and the sealing ring remains virtually constant. Since the working pressure in the piston chamber acts to the same degree on the inner geometry of the sealing ring, the sealing ring is thus correspondingly widened. The shape or wall thickness of the inner contour of the sealing ring can then be designed in such a manner that the sealing ring expands exactly to the same extent as the inner diameter of the piston bore of the cylinder barrel. As a result, the gap remains constant. In a first approximation, this can be achieved by the bead-like recess of the sealing ring. At very high pressures, for example 350 bar and above, the cross-sectional shape of the sealing ring can be precisely determined by means of a geometry-optimized design of the ring geometry via corresponding deformation analyses with the finite element method.

In an alternative embodiment, the central inner opening of the sealing ring has a stepped profile. A first step has a first internal diameter and a second step has a second internal diameter, wherein the second internal diameter is selected to be greater than the first internal diameter. In this case, the first inner diameter corresponds to the inner diameter of a non-stepped sealing ring. The first inner diameter can therefore be adapted to the pin diameter of the sealing ring seat, so that the first inner diameter can be optimized for the transmission of torques between the cylinder barrel and the piston/piston plate via the contact surface of the sealing ring and the pin. However, the second inner diameter, because it is not involved in the torque transmission, can then be optimized for an optimum expansion in order to adapt to increasing, high operating pressures of the widening piston bore.

In one embodiment, the sealing ring consists of metal, for example iron, a steel alloy, or some other metal alloy. In particular, hardened steel with surface hardnesses greater than 48 Rockwell hardness test, HRC, in particular tempered steel, for example 100Cr6 with a surface hardness of approximately 62 HRC, in particular case-hardened steel, for example 16MnCr5 with a surface hardness of approximately 60 HRC, are suitable for this purpose. In contrast to many ceramics, sealing rings made of metal have the advantage that, with a correspondingly thin wall, they expand because of the internal piston pressure and thus contribute to a better seal between the sealing ring and the piston chamber inner wall. However, this effect can also be achieved with ceramics which have a modulus of elasticity similar to that of steel. For example, with ceramics made of zirconium oxide $ZrO_2$, rings of zirconium oxide $ZrO_2$ and steel expand essentially to the same degree.

In a further embodiment, the surface properties of a sealing ring made of metals, with respect to surface hardness, friction coefficients, and wear resistance, are improved by downstream processes such as, for example, nitrating, nitrocarburizing, or hard-material coating.

A sealing ring obtained from a spherical disk does not necessarily have to be symmetrical in the axial direction. By means of a geometry with an asymmetrical spherical disk, the pressure-dependent clearance between the spherical ring and the cylinder wall can be kept small in order to achieve the lowest possible leakage. The spherical ring is specifically expanded by this design and by the applied pump pressure.

In a further embodiment, the sealing ring is secured in the sealing ring seat with a cover to prevent movement along the longitudinal axis of the piston. The cover forms the piston base and at the same time limits, for a downward movement of the piston—that is to say, in the expansion phase-apart from an intended vertical clearance, a migration of the sealing ring in the direction of the cover.

In a further embodiment, the cover is attached to the piston by means of a screw, or by clamping or by a press fit. These are fastening methods which enable a removal of the cover in the case of repair, and thus simplify the replacement of the sealing ring in the event of wear.

Viewed mathematically, the surface of the sealing ring formed in a spherical shape in certain regions that comes into contact with the inner walls of the cylinder is a symmetrical spherical zone. A spherical zone is the curved outer side of a spherical disc or a spherical ring, for example. A spherical disk, or also called a spherical layer, is obtained as the center part of a full sphere if the full sphere is cut into three parts by two parallel planes. If the parallel planes in this case lie on different sides of the sphere center point and at the same time are at the same distance from the sphere center point, this will be a symmetrical spherical disk whose outer surface results in a symmetrical spherical zone. If the two parallel sectional planes have different distances from the sphere center, an asymmetrical spherical disk can also be produced very easily in this way. Since the technical effort to produce a sufficiently perfect spherical shape is relatively small, such a sealing ring can be produced with relatively little effort from solid spheres with a corresponding diameter by removing spherical segments on both sides of a selected spherical great circle, for example by milling, as a result of which the desired symmetrical or asymmetrical spherical disk is produced. Such solid spheres are available, for example with corresponding manufacturing precision, for ball joints and pivot bearings as standard components, and are thus generally and cost-effectively available.

A spherical disk obtained in such a way can then be provided with a bore—a central opening with the desired diameter—which allows the sealing ring to be received in a pin. As provided in the alternative embodiments, the inner side of the sealing disk can be milled out in order, for example, to adapt the wall thickness of the sealing ring to a desired profile.

In a further embodiment, the pistons are attached to the piston plate by one end. Due to the fact that changes in the position of the piston in the cylinder are completely compensated for by the clearance of the sealing ring and the partially spherical shape of the sealing ring, the piston does not require any joints or sliding shoes on the end of the piston facing away from the piston base. Rather, it can be fixedly connected to the piston plate.

In a further embodiment, the piston diameter tapers increasingly in the region between the sealing ring seat and the one end. A tilting movement of the piston within the cylinder is thus made possible, which prevents contact of the piston with the inner cylinder walls during operation.

In a further embodiment, the piston has the shape of a truncated cone in the region between the sealing ring seat and the one end.

In a further embodiment, piston bore axes of the cylinders are distributed on a first circular line, the piston bore reference circle, around a cylinder barrel axis, and the piston longitudinal axes are distributed on a second circular line, the piston reference circle, around a piston plate axis, wherein the diameter ($D_K$) of the second circular line is selected to be greater than the diameter ($D_Z$) of the first circular line. The size differences between the first circular line and the second circular line can be compensated for by the inventive design of sealing ring and pins, thereby achieving a more compact design of the axial piston machine.

In a further embodiment, this design of the piston is used in a so-called floating piston machine.

In a further embodiment, the axial piston machine is designed as a swashplate machine.

Figure 2:
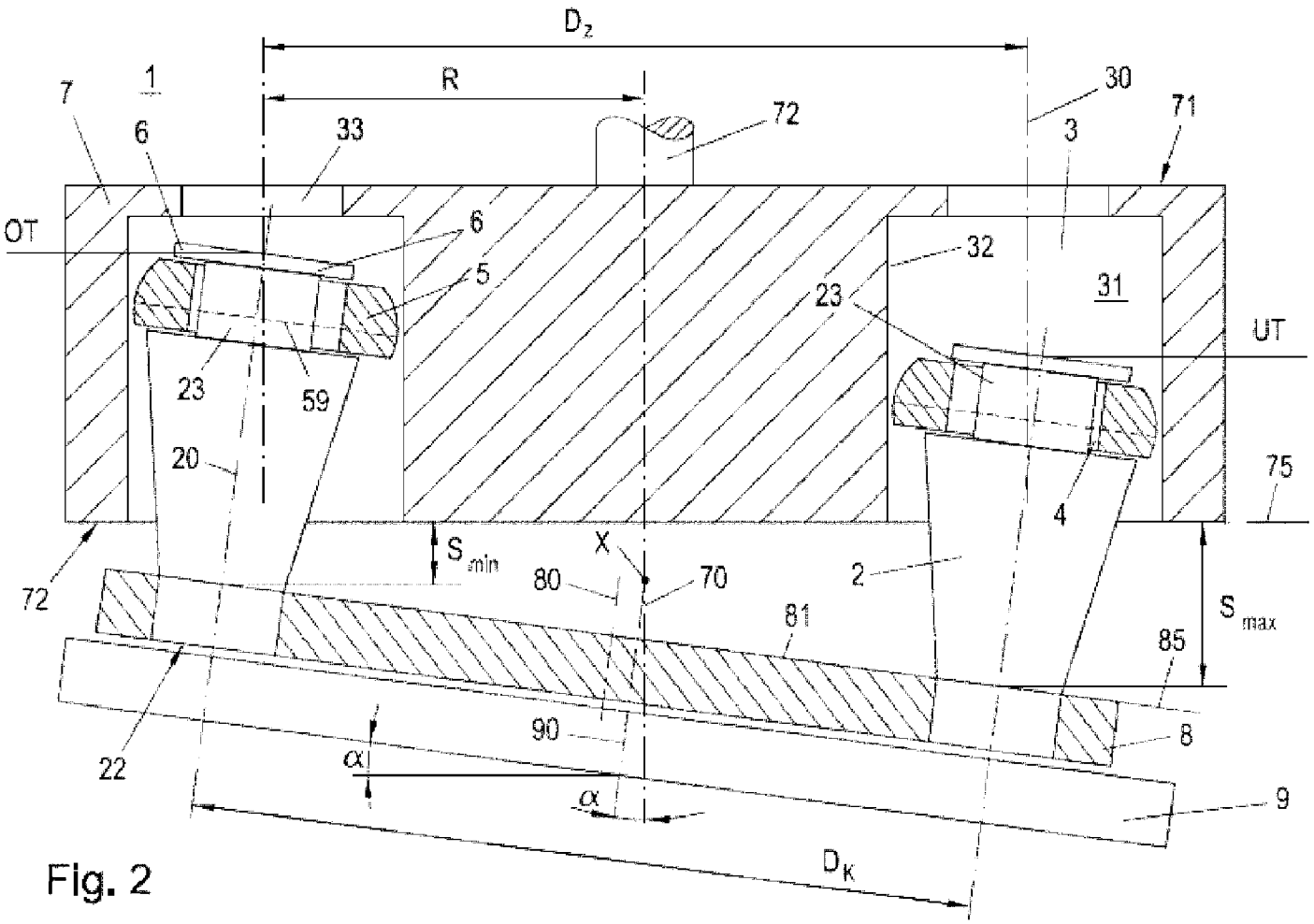
Figure 3:
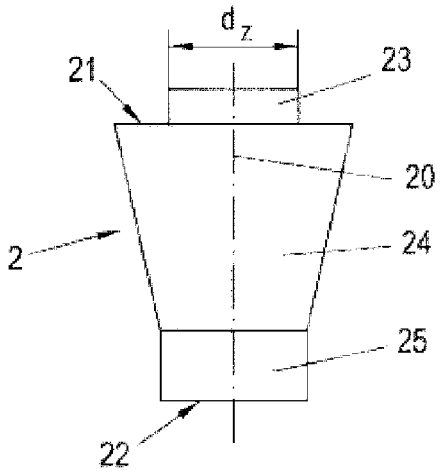
Figure 4:
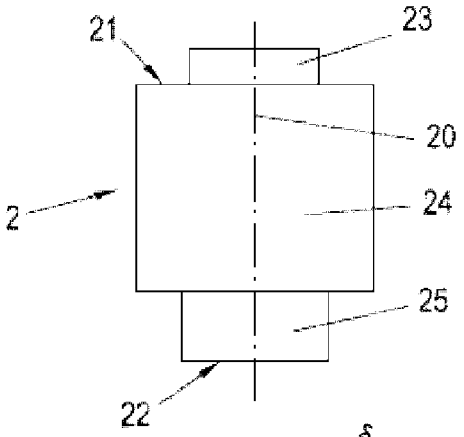
Figure 5:
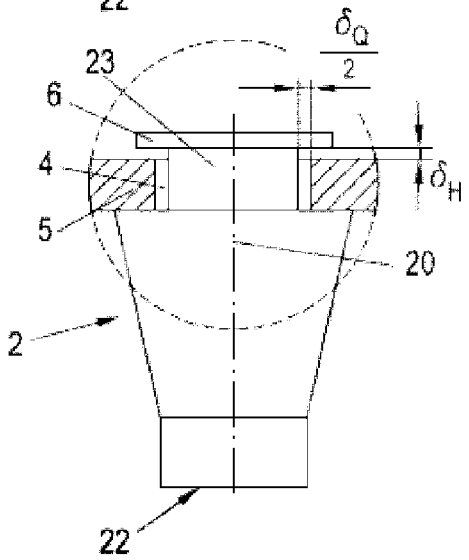
Figure 6:
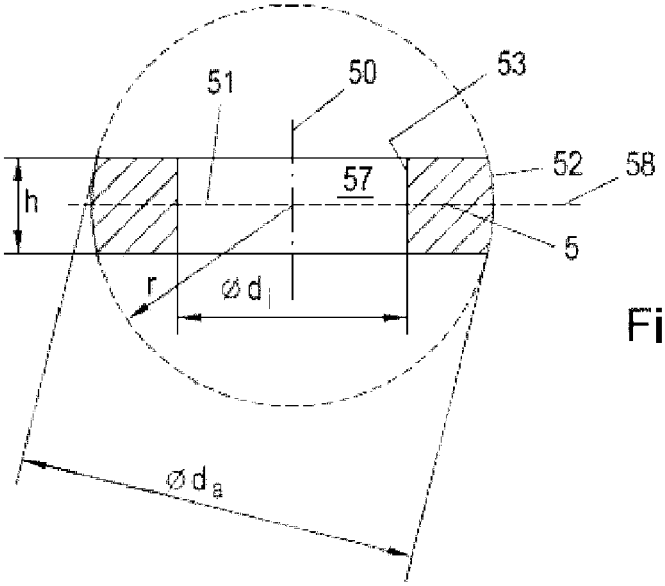
Figure 7:
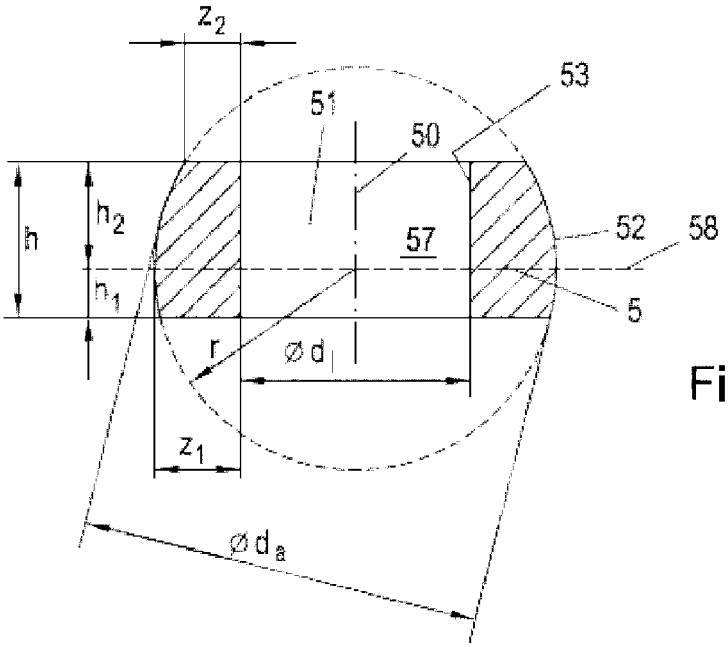
Figure 8:
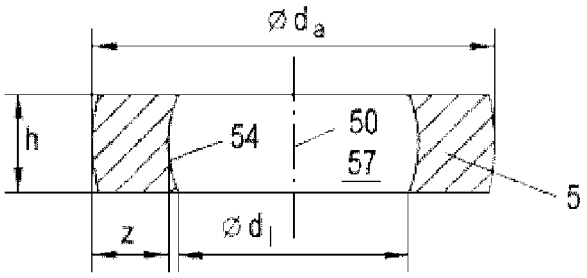
Figure 9:
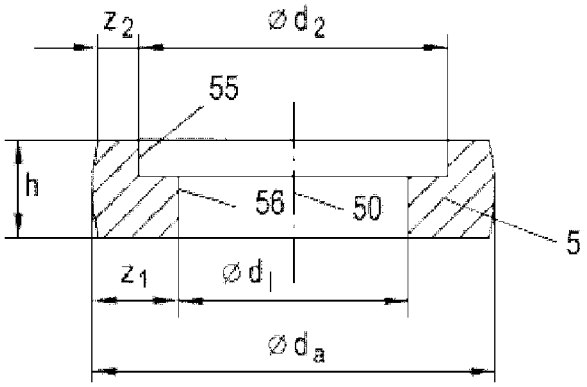
Figure 10:
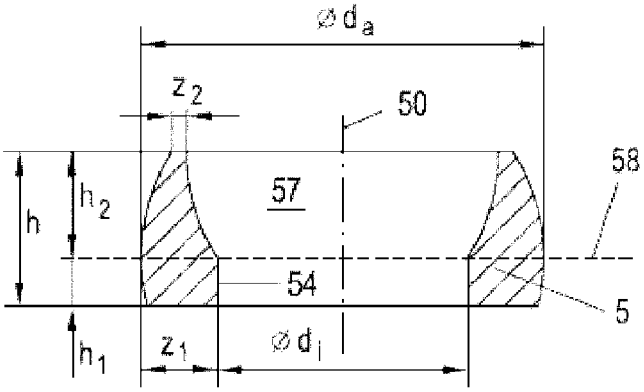
Figure 11:
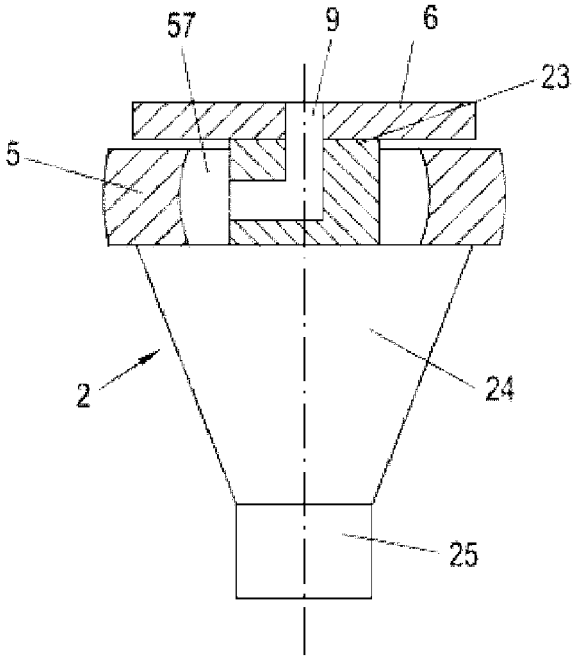
Figure 12:
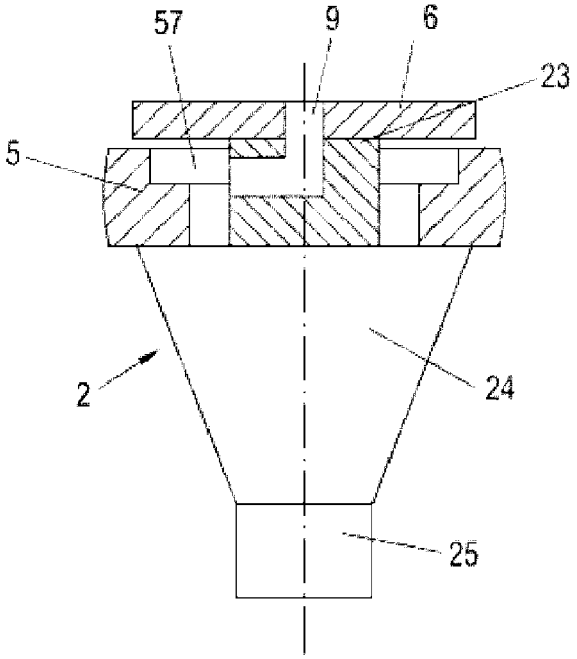

The invention is now described and explained in more detail on the basis of exemplary embodiments depicted in the drawings. The figures show:

FIG. 1 shows a schematic drawing of an axial piston machine with the pistons designed according to the invention, in a neutral position FIG. 2 shows a schematic drawing of an axial piston machine with the pistons designed according to the invention, in a pivoted position FIG. 3 shows a frustoconical structure of a piston FIG. 4 shows a cylindrical structure of a piston FIG. 5 shows a frustoconical piston with the installed sealing ring FIG. 6 shows an exemplary embodiment of a symmetrical sealing ring FIG. 7 shows an exemplary embodiment of an asymmetrical sealing ring FIG. 8 shows an exemplary embodiment of a symmetrical sealing ring with an inner bead FIG. 9 shows an exemplary embodiment of a sealing ring with a stepped inner side FIG. 10 shows an exemplary embodiment of a sealing ring with a continuous widening of its inner diameter in its upper region FIG. 11 shows a piston with a sealing ring with a bead-like inner recess and a pressure equalization bore FIG. 12 shows a piston with a sealing ring with a stepped internal profile and a pressure equalization bore FIG. 1 and FIG. 2 show the schematic structure of a so-called floating piston machine representative of the construction and function of axial piston machines. FIG. 1 and FIG. 2 show the same floating piston machine in different working states. The structure and function of a floating piston machine are known well enough to the person skilled in the art that in FIG. 1 and FIG. 2 only the interaction of a piston 2 with a cylinder barrel 7, a piston plate 8 and a swashplate 9 is described. The piston plate 8 is supported on the swashplate 9 and is rotatably mounted thereon. FIG. 1 shows the floating piston machine 1 in a neutral state in which the swashplate 9 and cylinder barrel 7 are aligned parallel to one another, whereas FIG. 2 shows the floating piston machine 1 in a state in which the swashplate 9 and the cylinder barrel are not aligned parallel to one another.

In the exemplary embodiment, a plurality of cylinders 3 is distributed in a circular shape and uniformly around a cylinder barrel axis 70 of a cylinder barrel 7. In the exemplary embodiment, the cylinders 3 are designed as piston bores 3, and are herein referred to as such. However, it is clear to the person skilled in the art that a cylinder 3 can also be manufactured in a manner other than by a piston bore. In order to prevent harmonic vibrations, an odd number of piston bores 3 is usually chosen. Each piston bore 3 has a connecting bore 33 on the upper side 71 of the cylinder barrel 7, via which a pressure medium can be supplied to or discharged from the piston bores 3 on the so-called high-pressure side of the floating piston machine 1.

The cylinder barrel 7 is mounted such that a rotation about the cylinder barrel axis 70 is allowed. In order to transmit torques, a shaft 72 is arranged on the cylinder barrel 7, which shaft—in an operating mode of the floating piston machine as a pump-provides a drive shaft and—in an operating mode of the floating piston machine as an engine-provides an output shaft. In the exemplary embodiment described, the distance R from a piston bore axis 30 to the cylinder barrel axis 70 is 45 mm, and the piston bores 3 each have an inner diameter D of 15 mm. In order to illustrate the invention better, the figures are not true to scale and provide details in part in a greatly enlarged manner.

The pistons 2 are rotationally symmetrical. The axis of symmetry of the piston 2 is also referred to below as the longitudinal axis 20 of the piston 2. FIG. 3 shows the basic structure of a piston 2 with a piston head 21 at its upper end and a piston foot 22 at its lower end. In the context of a piston 2, the directional indication "upward" refers to a movement of the piston 2 within the piston chamber 31 in the direction of the piston head 21, while the directional indication "downwards" denotes a movement of the piston 2 within the piston chamber 31 in the direction of the piston foot 22. The piston head 21 typically has a larger diameter than the piston foot 22. The piston 2 can therefore have the shape of a truncated cone in its central region 24, according to FIG. 2. It is important that the diameter of the piston head 21 is selected such that the piston head 21 does not come into contact with an inner wall 32 of the piston bore 3 at any time of the operation of the piston machine. In this respect, the piston 2 can also be designed in its central region 24 in the form of a cylinder, as is shown in FIG. 4.

The piston plate 8 is designed as a circular disk; a piston plate axis 80 extends perpendicular to the piston plate 8 through the center point of the circular disk. The piston plate 8 is rotatably mounted so that the piston plate 8 can rotate about the piston plate axis 80. The swashplate 9 is also designed as a circular disk, wherein a swashplate axis 90 extends perpendicular to the swashplate 9 through the center point of the circular disk. In the neutral state of the floating piston machine 1, the piston plate axis 80 and the swashplate axis 90 are in a line with the cylinder barrel axis 70.

In the following, a plane which extends perpendicular about the cylinder barrel axis 70, as a cylinder barrel plane 75, and a plane which extends perpendicular to the piston plate axis is referred to as the piston plate plane 85. In the neutral state, the cylinder barrel plane 75 and the piston plate plane 85 are oriented parallel to one another. When the cylinder barrel 7 rotates, the distance between the bottom 72 of the cylinder barrel 7 and the upper side 81 of the piston plate 8 remains constant in the neutral position. Due to the constant distance, the pistons 2 do not perform a stroke movement. This distance between the bottom 72 of the cylinder barrel and the upper side 81 of the piston plate 8 is therefore referred to below as the neutral distance S0.

In this exemplary embodiment, the piston plate 8 is designed to be pivotable relative to the cylinder barrel plane 85. When the swashplate 9 is pivoted, it should be ensured that the cylinder barrel axis 70 and the swashplate axis 90 intersect at an angle $\alpha$ at a pivot point X. Since the piston plate 8 slides on the swashplate 9 and thus the piston plate 8 and the swashplate 9 always remain oriented parallel to one another, the consequence is that, because of a geometric law, the angle $\alpha$ at which the cylinder barrel plane 75 and the piston plate plane 85 intersect corresponds to the pivot angle $\alpha$. The pivot angle $\alpha$ also corresponds to the angle at which the piston axes 20 are tilted relative to the cylinder bore axis 30. At a pivot angle $\alpha=0°$, the neutral position, the pistons 20 are aligned parallel to the piston bore axes 30. At a pivot angle $\alpha$ not equal to 0°, one half of the piston plate 8 is tilted away from the cylinder barrel 7, and the other half of the piston plate is inclined toward the cylinder barrel 7, so that during a rotation the distance between the cylinder barrel bottom 72 and the piston plate upper side 81 changes continuously. During a rotation, the piston plate 8, proceeding from the middle distance, passes through a maximum distance $S_{max}$ after a quarter rotation of the circle; after a further quarter rotation of the circle, the upper side 81 of the piston plate 8 returns to the middle distance; after a further quarter rotation of the circle, the upper side 81 of the piston plate 8 passes through a minimum distance $S_{min}$ from the bottom of the cylinder barrel 7, and after a further quarter rotation of the circle, the piston plate 8 returns to its starting point. In order to illustrate these positions in FIG. 2, these distances and the two pistons/piston chambers are shown for an even number n of piston bores.

Since the piston foot 22 of the pistons 2 is fixedly connected to the piston plate 8, the pistons 2 are compelled to perform these up and down movements during a rotation of the cylinder barrel 7 and the piston plate 8. During the upward movement, the piston chamber 31, which is sealed by the sealing ring 5 with respect to the inner side of the housing, becomes smaller until the piston 2 reaches a top dead center OT, where it changes its stroke movement direction. The top dead center OT of the piston 2 is the same as the position in which the piston plate 8 has reached the minimum distance $S_{min}$. In the subsequent downward movement, the size of the piston chamber increases until the piston 2 reaches a bottom dead center UT, where the downward stroke movement changes once again into an upward stroke movement. The bottom dead center UT is the same as the position in which the upper side 81 of the piston plate 8 is at a maximum distance $S_{max}$ from the bottom 72 of the cylinder barrel 7.

The piston foot 22 is advantageously shaped as a cylinder because the piston foot 22 can accordingly be received by a passage bore in the piston plate 8. Since, adjacent to the piston foot 22 the piston is either widened as a truncated cone or forms a step to the larger cylindrical central part 24, the piston 2 is supported on the piston plate upper side 81 in order to divert the forces acting on the piston head 21 in the piston chamber 31 into the piston plate 8.

If the central part 24 has no widening relative to the piston foot 22, this support can alternatively be achieved in that the seats for the piston foot 22 are designed as blind holes, and each piston foot 22 is supported in a blind hole. The piston feet 22 are fixed against any type of movement, for example, by a press-fit in the passage bore or the blind hole. Alternatively, a connection can also be in the form of a positive fit or friction fit, for example by pressing, shrinking, a threading, or welding.

FIG. 5 shows a piston 4 with a sealing ring 5 mounted in a sealing ring seat 4. In this case, the sealing ring seat 4 has a pin 23 which is centered on the piston head 21 and which accommodates a central opening 51 of the sealing ring 5. The inner diameter $d_i$ of the center opening 51 is significantly greater in this case than the diameter $d_Z$ of the pin 23. A movement of the sealing ring 5 in the direction of the longitudinal axis 20 of the piston 2 is limited by a cover 6 which is mounted on the pin 23.

FIG. 6 shows a sealing ring 5 in its simplest embodiment in terms of manufacture. The sealing ring 5 of FIG. 6 is a spherical disk, wherein the spherical disk has the same heights h/2 upward and downward from an equatorial plane 58 of the sealing ring. The equatorial plane 58 includes the great circle on the peripheral surface 52 of the sealing ring which is perpendicular to the sealing ring axis 50. Because the same heights h/2 of the sealing ring are the same on both sides of the equatorial plane, it is therefore a symmetrical sealing ring 5. The diameter $d_a$ of the sealing ring, which ideally is somewhat smaller than the piston diameter d, is the result of the radius of curvature r.

We first consider the case where the piston plate plane 85 is oriented parallel to the cylinder barrel plane 75, and the cylinder barrel axis 70 coincides with the piston plate axis 80 and the swashplate axis 90—that is to say, the neutral position. When the cylinder barrel 7 and the piston plate 8 rotate in the neutral position, the pistons 2 do not perform a stroke movement because no relative movements occur in the direction of the piston bore axes 30. Thus, no vertical forces, i.e., forces parallel to the cylinder barrel axis 70, act on the sealing ring 5.

In the view of FIG. 2, we can see the situation in the case of a position of the swashplate 9 inclined relative to the cylinder barrel 7 by a pivot angle $\alpha <> 0°$. A rigid piston head describes an elliptical path during a rotation of the cylinder barrel 7 within the piston bore 3, and the apexes of the main axis of this elliptical path are passed through at the top dead center OT and bottom dead center UT. In the situation as shown in FIG. 2, when it reaches the top dead center OT, the piston 2 would protrude beyond the part of the inner wall 32 of the piston bore which has the least distance from the cylinder barrel axis 70—that is to say, lies closer to the cylinder barrel axis 70. In contrast to this, the piston 2 would project beyond the part of the inner wall 32 of the piston bore 3 which has the greatest distance from the cylinder barrel axis 70 when the piston 2 reaches its bottom dead center UT. In the illustration of FIG. 2, both pistons 2 would thus press against the respective right cylinder walls 31. For a rigid piston head 21 and a rigid cylinder barrel 7, this would inevitably lead to the piston head 21 jamming in the piston bores 3.

This jamming is counteracted in two ways in the floating piston machine 1 according to the invention. Firstly, the piston plate 8 is mounted displaceably on the swashplate 9. The pressures of the piston chambers 31 are transmitted via the rigid pistons 2 to the piston plate 8, and displace the piston plate 8 on the swashplate 9. This can be seen in FIG. 2, where the piston plate axis 80 is now located to the left of the swashplate axis 90. On the other hand, the sealing ring 5, because it is displaceably accommodated in the sealing seat 4, can deflect the forces acting on the sealing ring 5 from the inner walls 32 of the piston bore 3 transverse to the piston longitudinal axis. The inner diameter $d_i$ of the sealing ring 5 and the diameter $d_Z$ of the pin are ideally matched to one another in such a manner that the resulting clearance $\delta_Q$ is great enough that the sealing ring 5 can follow the elliptical path in cooperation with the displacement of the piston plate 8 on the swashplate 9, without jamming. When this clearance is correctly tuned, a torque can be transmitted from the cylinder barrel 7 via the sealing ring 5 to the piston plate 8, such that the piston plate is entrained by the cylinder barrel 7. Alternatively, however, the piston plate 8 can be synchronized with the cylinder barrel 7 by way of a gearing, for example, as a result of which greater freedom is achieved with respect to the inner sealing ring geometry and the pin 23.

By means of the partially spherical peripheral surface 52 of the sealing ring 5 with a radius of curvature r which substantially corresponds to half the piston bore diameter D/2, the piston bore inner wall 32 and sealing ring 5 contact each other in a circular line, the sealing circle 59, irrespective of how strongly the piston longitudinal axis 20 is tilted relative to the piston bore axis 30, and therefore how deeply the piston 2 dips into the piston bore 3 in its stroke movement. As a result, the plane in which the sealing circle 59 lies is always perpendicular to the piston bore axis 30. As a result, the wear in the contact between the sealing ring and the piston bore is reduced, and the axial piston machine is more efficient and more robust. The service life of the metallic sealing ring 5 is thus significantly higher than an elastically designed sealing ring according to the prior art.

In the following, the circular line on which the piston bore axes 30 are distributed about the cylinder barrel axis is designated as a piston bore reference circle, and the diameter of the piston bore reference circle is designated as the piston bore reference circle diameter Dz. The piston feet 22 and in particular the piston longitudinal axes 20 of the individual pistons 2 intersect the piston plate 8 perpendicularly, and are distributed uniformly about the piston plate axis 80 on a circular line, which is referred to below as the piston reference circle. The diameter of the piston reference circle is hereinafter referred to as the piston reference circle diameter $D_K$.

In one embodiment, the pistons 2 are arranged on the piston plate 8 such that the longitudinal axes 20 of the pistons 2 and the longitudinal axes 30 of the respective piston bores 3 coincide in the neutral position. Thus, the piston reference circle diameters DK and the piston bore reference circle diameters $D_Z$ are identical. If the distance R of the piston bore axes 20 from the cylinder barrel axis 70 is 45 mm as mentioned above, the piston bore reference circle diameter $D_Z$ is calculated as $D_Z$=2R=90 mm, and the piston reference circle diameter $D_K$ is also calculated as 90 mm.

However, it has been shown that the piston reference circle diameter $D_K$ can also in particular also be selected to be greater than the piston bore reference circle diameter $D_Z$. In a second embodiment, the piston reference circle diameter $D_K$ is equal to 90.4 mm. A piston reference circle diameter $D_K$ which is greater than the piston bore reference circle diameter $D_Z$ has the advantage that the floating piston machine can be constructed more compactly, because, with the same clearance do, a greater pivot angle $\alpha$ can be achieved. A piston reference circle diameter $D_K$ which is larger compared to the piston bore reference circle diameter $D_Z$ is made possible by the sealing rings 5, which are mounted in a manner allowing displacement transverse to the piston axis 20 and compensate for the greater piston axis distance $D_K$ by the sealing rings 5 moving in the sealing ring seat 4.

In a further embodiment shown in FIG. 8, the inner wall of the sealing ring 5 is provided with an inner bead 54, so that the sealing ring 5 has, for example, a constant material thickness over its height h in the vertical direction. The background for a geometry of the sealing ring deviating from the pure ring shape is the following:

If a piston chamber 31 of the cylinder barrel 7 is connected to the high-pressure side via the connecting bores 33, this high pressure (up to 350 bar or more) acts on the inner wall 32 of the bore of the cylinder barrel 7 which forms the piston chamber 31. It has been shown that this internal pressure force can lead to a widening or deformation of the corresponding piston bore 3, despite the solid design of the cylinder barrel 7. Such a one-sided widening would lead to an increase in the gap 34 between the piston bore 3 and the sealing ring 5. In order to compensate for this disadvantage, the invention proposes to design the sealing ring 5, with respect to its geometry, in such a way that, when the inner side of the sealing ring 5 is subjected to radial pressure forces, the sealing ring can expand accordingly, and thus the gap 34 between the piston bore 3 and the sealing ring 5 remains ideally constant over the entire range of the operating pressure. The clearance $\delta_Q$, as well as $\delta_H$ allows the pressure to find its way into the region behind the sealing ring or into the space between the pin 23 and the inner diameter 5. Since the working pressure in the piston chamber 31 acts on the inner geometry of the sealing ring 5 at the same height, the sealing ring 5 is correspondingly widened with a correspondingly adapted wall thickness and/or adapted cross-sectional profile.

In a first variant, this can be achieved by the sealing ring 5 having a bead-like recess 54 on its inner side 53. This bead-like recess 54 can, for example, be designed in such a manner that the sealing ring 5 has approximately the same horizontal thickness z over its vertical profile h. As a result of this uniform horizontal thickness z, the sealing ring can be deliberately weakened in order thus to yield to a pressure acting on the inner side of the sealing ring by widening, i.e., by enlarging its outer diameter da.

In an alternative embodiment of the sealing ring, as shown in FIG. 7, a decrease in the sealing ring wall thickness is achieved by the sealing ring 5 being asymmetrical. That is, the height $h_2$ of the sealing ring measured upward from its equatorial plane 58 is greater than the height $h_1$ of the sealing ring measured downward from its equatorial plane 58. In this way, the lower wall thickness $z_2$ of the sealing ring 5 at its upper end with respect to the wall thickness $z_1$ of the sealing ring at its lower end is deliberately permitted in order to allow yielding to the high pressure of the pressure medium in the piston interior. The desired widening of the sealing ring can be tuned accordingly via the upper height $h_2$.

In a further embodiment shown in FIG. 9, the inner diameter of the sealing ring is stepped. The inner diameter $d_2$ is made larger in the upper part—that is, the part which faces the cover of the piston 2—than the inner diameter $d_i$ in the lower part. As an alternative to an approximately constant sealing ring cross-sectional thickness z according to the embodiment shown in FIG. 6, the sealing ring 5, due to the lesser material thickness $z_2$ yields to a higher operating pressure in its upper region, while the sealing ring 5, due to the higher material thickness $z_1$ in its lower region, largely retains its shape, and thus the adaptation between the inner ring diameter $d_i$ and the pin diameter $d_z$ is not altered. The desired widening of the sealing ring in its upper region can in particular be set by the upper diameter $d_2$ and the height at which the step between the upper and lower regions is arranged.

In an alternative embodiment, which is shown in FIG. 10, the inner diameter of the sealing ring expands continuously upward over its height, as a result of which the wall thickness of the sealing ring 5 decreases as the height increases, and can thus even more easily yield to the pressure of the sealing ring in the interior space 57. In its lower region, the sealing ring 5 extends over a first height $h_1$ downward from the equatorial plane, and in its upper region extends upward over a second height $h_2$. Depending on how much expansion is required, the widening of the interior 57 of the sealing ring 5, as shown at the equatorial plane 58, can, however, also begin only above or alternative also below the equatorial plane 58. For this purpose, both a sealing ring 5 designed to be symmetrical, in which the first height $h_1$ is equal to the second height $h_2$, and also, as shown in FIG. 10, an asymmetrically designed sealing ring 5, in which the first height $h_1$ is different from the second height $h_2$, can be used. A geometry-optimized design of the ring geometry as a function z (h) over the height of the sealing ring 5 can, if necessary, also be determined sufficiently precisely, for example, by means of corresponding deformation analyses with the finite element method.

Since the widening of the piston inner wall 32 depends on many factors, such as the material used for the cylinder barrel 7, the piston bore diameter d, the wall thicknesses between two adjacent piston bores 3, to name the most important ones, no general formula can be specified here. In laboratory tests, however, it has been shown that, at operating pressures of 350 bar, the widening of the piston bore 3 in the dimensioning selected in the exemplary embodiment can be between 10 μm and 30 μm—in special individual cases, also greater or less than this. A method for determining the cross-sectional thickness z of the sealing ring therefore consists in initially determining the deformation of the piston bore 3 at the highest intended operating pressure in a first step. In a test series, sealing rings 5 with different cross-sectional thicknesses z are subjected to the highest intended operating pressure, and the resulting increase in diameter Δd of the sealing ring 5 is determined. The sealing ring geometry is then selected—that is, in this case, the sealing ring 5 with the cross-sectional thickness z at which the difference Δd between the measured piston inner wall diameter d+Δd under load at the highest operating pressure and the sealing ring diameter $d_i+\Delta d_i$ under load at the highest operating pressure corresponds to the selected clearance between the piston inner wall 32 and the sealing ring 5.

Alternatively or additionally to a pressure equalization via the vertical and the horizontal clearance of the sealing ring 5 in the sealing ring seat 4, a pressure equalization between the piston interior 31 and the interior 57 of the sealing ring 5 can also be achieved by one or more openings in the cover 6. FIG. 11 shows an embodiment of a piston 2 with a sealing ring 5 with a bead-like recess on the inner wall 54 of the sealing ring 5. In this exemplary embodiment, a pressure equalization between the piston interior 31 and the interior 57 of the sealing ring 5 is provided by one or more pressure equalization bores 9, which extend downward from the upper side of the cover 6 through the pin 23 and then in the radial direction of the pin 23. Such a pressure equalization is suitable both for sealing rings 5 with a continuous profile of the sealing ring thickness z and, as shown in FIG. 12, for sealing rings with a stepped inner profile. In this exemplary embodiment, a pressure equalization between the piston interior 31 and the interior 57 of the sealing ring 5 is also provided by one or more pressure equalization bores 9, which extend downward from the upper side of the cover 6 through the pin 23 and then in the radial direction of the pin 23.

The invention claimed is:

1. An axial piston machine in which pistons in cylinders execute a stroke movement, and in which the pistons have a sealing ring seat for a sealing ring, wherein the sealing ring seat is operatively configured such that it permits a movement of the sealing ring transverse to a longitudinal axis of the piston, wherein the sealing ring is spherical in shape at least in a region which effects a seal during the stroke movements on inner walls of a first cylinder of the cylinders, wherein the radius of curvature of the sealing ring is formed in a spherical shape in certain regions and corresponds to half a diameter of the first cylinder, and wherein the sealing ring is secured in the sealing ring seat with a cover against a movement along the longitudinal axis of the piston.

2. The axial piston machine according to claim 1, wherein the sealing ring is made of a material selected from a group consisting of a non-deformable material, a metal, a metal alloy, an oxide ceramic, a non-oxide ceramic, and a zirconium oxide ceramic.

3. The axial piston machine according to claim 1, wherein the sealing ring comprises a rigid material which is resistant to wear.

4. The axial piston machine according to claim 1, wherein the sealing ring seat comprises a pin having a pin diameter and the sealing ring has a central inner opening corresponding to the pin, and wherein an inner diameter of the sealing ring is greater than the pin diameter.

5. The axial piston machine according to claim 1, wherein a cross-section of the sealing ring is operatively configured such that, at a high operating pressure, a deformation of the sealing ring by an operating pressure largely compensates for a widening of the inner wall of the first cylinder by the operating pressure.

6. The axial piston machine according to claim 5, wherein the piston is configured to operatively enable a pressure equalization between a piston interior and an interior of the sealing ring.

7. The axial piston machine according to claim 6, wherein the pressure equalization between the piston interior and the interior of the sealing ring is enabled by one or more openings in the cover securing the sealing ring in the sealing ring seat against a movement along the longitudinal axis of the piston and/or one or more pressure equalization bores, which extend from an upper side of a pin of the sealing ring seat into the interior of the sealing ring.

8. The axial piston machine according to claim 1, wherein a central inner opening of the sealing ring has a circumferential bead-like recess.

9. The axial piston machine according to claim 1, wherein the cover is attached to the piston by means of a screw or by clamping or by pressing.

10. The axial piston machine according to claim 1, wherein the piston is fastened to a piston plate by a first end.

11. The axial piston machine according to claim 1, wherein the cylinders are distributed over a cylinder barrel around a cylinder barrel axis, and wherein the pistons are distributed over a piston plate around a piston plate axis, and wherein a rotation of the cylinder barrel about the cylinder barrel axis and a rotation of the piston plate about the piston plate axis are synchronized with each other and the synchronization does not take place by a torque transmission via the pistons.

12. The axial piston machine according to claim 1, wherein the cylinders comprise piston bore axes distributed on a first circular line around a cylinder barrel axis, and wherein the pistons comprise piston longitudinal axes distributed on a second circular line around a piston plate axis, and wherein a diameter of the second circular line is greater than a diameter of the first circular line.

13. The axial piston machine according to claim 1, wherein the axial piston machine is a floating piston machine.

14. The axial piston machine according to claim 1, wherein the axial piston machine is a swashplate machine.

15. A method for producing a sealing ring according to claim 1, wherein a solid sphere is selected as the starting product, and in that two spherical segments are removed parallel to a great circle of the solid sphere to form a spherical disk.

16. The method for producing a sealing ring according to claim 15, wherein a central bore is made through an axis of rotation of the spherical disk.

17. The axial piston machine according to claim 1, wherein a central inner opening of the sealing ring has a stepped profile.

18. The axial piston machine according to claim 1, wherein a horizontal clearance between an inner diameter of the sealing ring and a pin of the sealing ring seat, and a vertical clearance of the sealing ring within the sealing ring seat are selected to be at least great enough that they operatively enable the pressure equalization between the piston interior and the interior of the sealing ring.

19. The axial piston machine according to claim 1, wherein a piston diameter in a region between the sealing ring seat and the first end tapers increasingly.

20. An axial piston machine in which pistons in cylinders execute a stroke movement, and in which the pistons have a sealing ring seat for a sealing ring, wherein the sealing ring seat is operatively configured such that it permits a movement of the sealing ring transverse to a longitudinal axis of the piston, wherein the sealing ring is spherical in shape at least in a region which effects a seal during the stroke movements on inner walls of a first cylinder of the cylinders, wherein the radius of curvature of the sealing ring is formed in a spherical shape in certain regions and corresponds to half a diameter of the first cylinder, wherein a cross-section of the sealing ring is operatively configured such that, at a high operating pressure, a deformation of the sealing ring by an operating pressure largely compensates for a widening of the inner wall of the first cylinder by the operating pressure, and wherein a central inner opening of the sealing ring has a stepped profile.

21. An axial piston machine in which pistons in cylinders execute a stroke movement, and in which the pistons have a sealing ring seat for a sealing ring, wherein the sealing ring seat is operatively configured such that it permits a movement of the sealing ring transverse to a longitudinal axis of the piston, wherein the sealing ring is spherical in shape at least in a region which effects a seal during the stroke movements on inner walls of a first cylinder of the cylinders, wherein the radius of curvature of the sealing ring is formed in a spherical shape in certain regions and corresponds to half a diameter of the first cylinder, wherein a cross-section of the sealing ring is operatively configured such that, at a high operating pressure, a deformation of the sealing ring by an operating pressure largely compensates for a widening of the inner wall of the first cylinder by the operating pressure, and wherein a horizontal clearance between an inner diameter of the sealing ring and a pin of the sealing ring seat, and a vertical clearance of the sealing ring within the sealing ring seat are selected to be at least great enough that they operatively enable the pressure equalization between the piston interior and the interior of the sealing ring.

22. The axial piston machine according to claim 11, wherein the sealing ring is secured in the sealing ring seat with a cover against a movement along the longitudinal axis of the piston.

23. The axial piston machine in which pistons in cylinders execute a stroke movement, and in which the pistons have a sealing ring seat for a sealing ring, wherein the sealing ring seat is operatively configured such that it permits a movement of the sealing ring transverse to a longitudinal axis of the piston, wherein the sealing ring is spherical in shape at least in a region which effects a seal during the stroke movements on inner walls of a first cylinder of the cylinders, wherein the radius of curvature of the sealing ring is formed in a spherical shape in certain regions and corresponds to half a diameter of the first cylinder, wherein the piston is fastened to a piston plate by a first end, and wherein a piston diameter in a region between the sealing ring seat and the first end tapers increasingly.

24. The axial piston machine according to claim 23, wherein the piston has a shape of a truncated cone in the region between the sealing ring seat and the first end.

* * * * *